US008052539B2

(12) United States Patent
Kimber

(10) Patent No.: US 8,052,539 B2
(45) Date of Patent: Nov. 8, 2011

(54) SWING PERFORMANCE ANALYSIS DEVICE

(76) Inventor: Peter Kimber, Hampshire (GB)

( * ) Notice: Subject to any disclaimer, the term of this patent is extended or adjusted under 35 U.S.C. 154(b) by 697 days.

(21) Appl. No.: 12/089,392

(22) PCT Filed: Oct. 5, 2006

(86) PCT No.: PCT/GB2006/003711

§ 371 (c)(1),
(2), (4) Date: Aug. 23, 2008

(87) PCT Pub. No.: WO2007/039748

PCT Pub. Date: Apr. 12, 2007

(65) Prior Publication Data

US 2009/0131190 A1 May 21, 2009

(30) Foreign Application Priority Data

Oct. 6, 2005 (GB) ..... 0520373.2

(51) Int. Cl.
*A63B 69/36* (2006.01)

(52) U.S. Cl. ..... 473/222; 473/223

(58) Field of Classification Search ..... 473/222, 473/223

See application file for complete search history.

(56) References Cited

U.S. PATENT DOCUMENTS

| | | | |
|---|---|---|---|
| 5,688,183 | A | 11/1997 | Sabatino et al. |
| 6,441,745 | B1 | 8/2002 | Gates |
| 2002/0173364 | A1 | 11/2002 | Boscha |
| 2005/0215340 | A1 | 9/2005 | Stites et al. |
| 2006/0052173 | A1 | 3/2006 | Telford |

FOREIGN PATENT DOCUMENTS

| | | | |
|---|---|---|---|
| JP | 10-127845 | A | 5/1998 |
| WO | WO 00/69528 | | 11/2000 |
| WO | WO 03/089940 | A | 10/2003 |

*Primary Examiner* — Peter DungBa Vo
*Assistant Examiner* — Damon Pierce
(74) *Attorney, Agent, or Firm* — Leason Ellis LLP

(57) ABSTRACT

A swing performance analysis device (10) is described. The device (10) includes a sole single axis accelerometer securable to an entity (60, 70) to be swung to measure centripetal acceleration. The accelerometer is arranged to communicate with a processor (30). The processor (30) is arranged to accept one or more parameters on the swing to be analysed and measurement data on the swing from the accelerometer, the processor being operative to determine the radius of curvature of the swing calculate in dependence on the one or more parameters and to determine one or more attributes on the swing in dependence on the radius and measurement data.

10 Claims, 4 Drawing Sheets

SWING PERFORMANCE ANALYSIS DEVICE

FIELD OF THE INVENTION

The present invention relates to a device for analysing swing performance that is particularly applicable for use in golf training.

BACKGROUND TO THE INVENTION

Current systems of training for golfers are many and various. Some are purely mechanical, and help to train the user in technique by guiding the club into a motion thought to be preferable to achieve good results. Others measure some aspect of the player's performance during practice, and provide information which the player can use to improve their swing.

Many different schemes have been proposed for measuring and analysing various aspects of a golf swing. The depth of the analysis provided varies from a simple speed indicator to complex 3-dimensional motion and/or video analysis.

Speed indicators are typically either free-standing or attach to, or form part of, the club. Free standing indicators typically employ a sensor arrangement that uses magnetic forces, light beams or microwave radar to measure club activity and motion. More complex methods use gyroscopes and multi-axis accelerometers or video cameras/recorders connected to a computer for analysis.

Radar and light/laser devices are typically expensive, obtrusive, inaccurate, and can be difficult to set up. In the case of the radar devices, the point of measurement is not well defined. As the speed of, and therefore distance traveled by, the ball is dependent on the speed of the club head at impact, measurements at other times are not useful in this respect. Radar and laser devices also only produce speed information, which is, by itself, insufficient. More complex methods produce detailed results, but these require considerable skill and/or expertise to interpret, and so are not useful to the majority of golfers.

Speed measuring devices exist, such as that disclosed in U.S. Pat. No. 3,815,427, which fix to the club typically use one or more accelerometers to derive club head speed indirectly, by combining centripetal acceleration with radius of curvature. However these tend to be inaccurate for a number of reasons.

Firstly, they do not properly take into account the radius of curvature of the swing at the point of impact. Secondly, if the device is not attached close to the club head, then accurate measurement will not be possible. One reason for this difficulty is the inability to take account of shaft flexion. All these problems may be overcome by building the device into the head of the club, but this is expensive and very inconvenient.

Some methods require knowledge of properties of the equipment, such as the weight of the club head, and/or the ball. Furthermore, none of the systems or devices known to the applicant take into account the slowing distance of the club (the distance traveled by the club head between reaching peak speed and the instant of impact with the ball) which clearly affects the accuracy of any measurements provided.

STATEMENT OF INVENTION

According to an aspect of the present invention, there is provided a swing performance analysis device comprising a sole single axis accelerometer securable to an entity to be swung to measure centripetal acceleration, the accelerometer being arranged to communicate with a processor, wherein the processor is arranged to accept one or more parameters on the swing to be analysed and measurement data on the swing from the accelerometer, the processor being operative to determine the radius of curvature of the swing calculate in dependence on the one or more parameters and to determine one or more attributes on the swing in dependence on the radius and measurement data.

Preferably, the device is securable on a shaft of a golf club substantially adjacent to the golf club's head.

Preferably, the device comprises a housing securable to the shaft of the golf club, the accelerometer being mounted in the housing such that upon securement of the device to the shaft of the golf club, the axis of measurement of the accelerometer is parallel to the longitudinal axis of the shaft.

The one or more parameters may include the length of the user's arm.

Preferably, the processor is arranged to monitor measurement data from the accelerometer to determine when a swing is being taken and a point of impact, wherein measurement data corresponding to a swing being taken comprises a low frequency waveform and measurement data corresponding to a point of impact comprises a high frequency burst or sudden reduction in centripetal acceleration.

A swing may be deemed to have started when the output of the accelerometer reaches a predetermined threshold.

In order to save energy, the processor may be arranged to sample measurement data more frequently once a swing is deemed to have started.

The processor is preferably arranged to determine a peak speed of the swing, the peak speed comprising measurement data received from the accelerometer having a smaller magnitude than its predecessor.

Upon detection of a point of impact, the processor is arranged to calculate club head velocity:

$$v_i=\sqrt{(a_i*r)}$$

where $a_i$=measurement data from the accelerometer immediately preceding the point of impact r=distance to centre of rotation calculated in dependence on the one or more parameters.

By fixing a detachable device to the shaft, as close to the head of the club as possible, and making accurate measurements of the centripetal acceleration throughout the stroke, suitable mathematical formulae can be used to calculate the required quantities. This data should consist of at least the following: club head speed at impact, peak speed, and slowing distance. These results can be immediately presented to the golfer, clearly and unambiguously, and in such a way that they are easy to interpret, without requiring special skill or knowledge.

The device would preferably be easy to set up, and would require only one measurement to be input by the user, which should be easy to determine. It would be easy to clip onto the shaft of most clubs, and would be secure in use. The device should ideally work in both imperial and metric units, it should be reliable, and have adequate battery life.

Being positioned close to the club head, having an accurate measurement capability, and properly taking into account the radius of curvature at the point of impact, the invention overcomes the problems of prior art.

Any mass added to the club, especially near the head, is likely to adversely affect the balance of the club. It is therefore essential to keep the mass of the device as low as possible, preferably below 50 grams. This can be achieved by using highly integrated electronics and tightly controlled construction techniques.

BRIEF DESCRIPTION OF THE DRAWINGS

Embodiments of the present invention will now be described in detail, by way of example only, with reference to the accompanying drawings in which.

DETAILED DESCRIPTION

Figure 1:
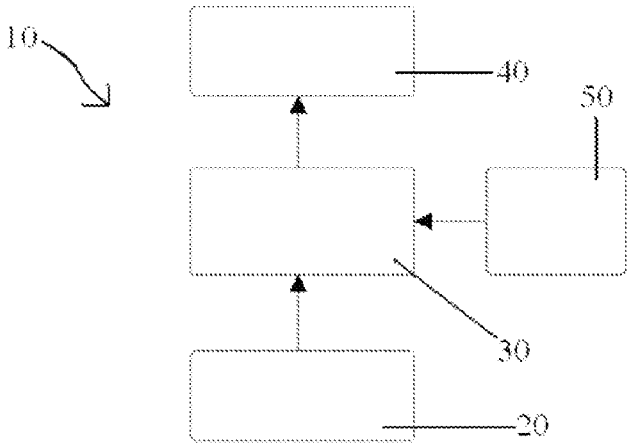
FIG. 1 is a schematic diagram of an analysis device according to an embodiment of the present invention.

FIG. 1 is a schematic diagram of an analysis device according to an embodiment of the present invention.

The analysis device 10 includes a single-axis accelerometer 20, a processor 30, a display 40, and user controls 50.

Figure 2:
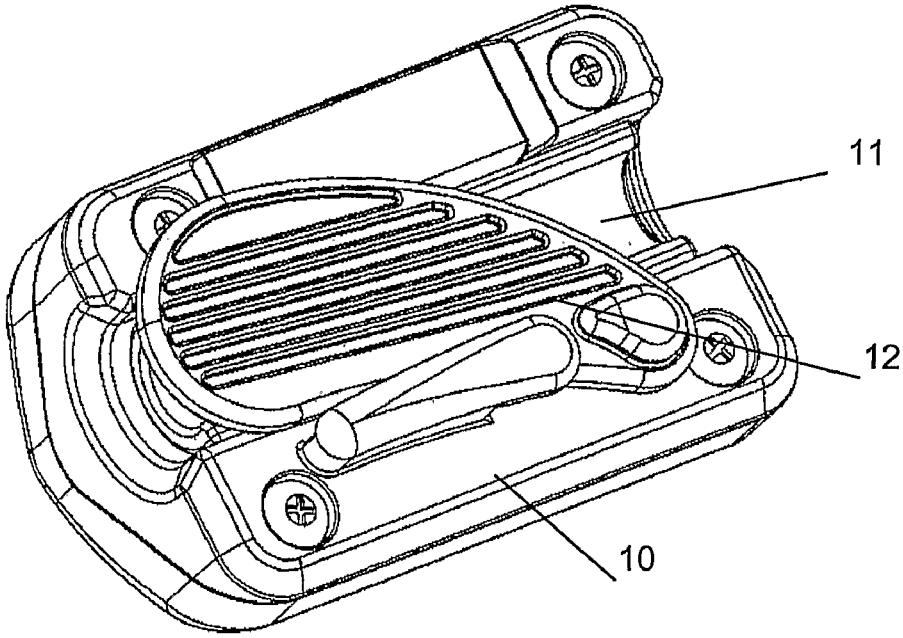
FIGS. 2 and 3 are perspective views of the analysis device of FIG. 1.
Figure 3:
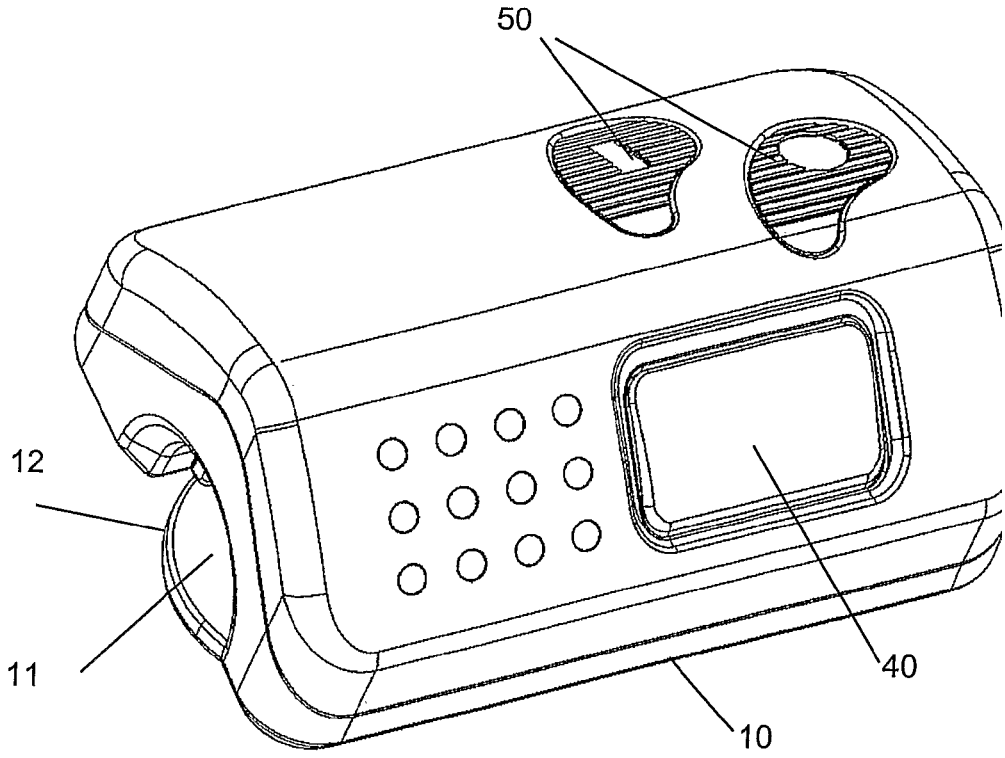
Figure 4:
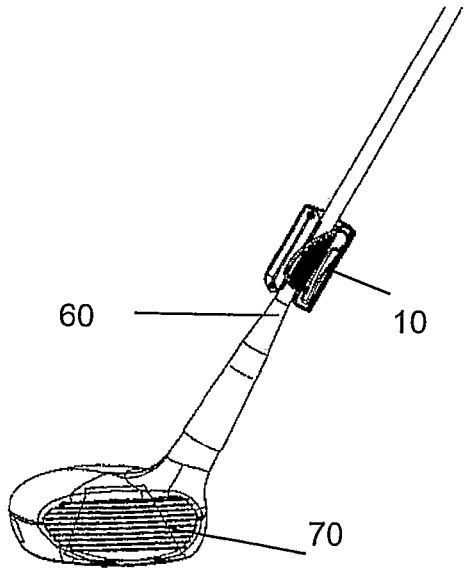
FIG. 4 is a perspective view of the device of FIGS. 2 and 3 secured to the shaft of a golf club.

FIGS. 2 and 3 are perspective views of the analysis device of FIG. 1;

Preferably, the device 10 is self-contained and includes an aperture 11 and securing means 12 enabling the device to be secured to the shaft of a golf club, as is shown in FIG. 4.

The device is secured on the shaft 60 as close as possible to the club head 70.

In order to measure centripetal acceleration along the axis of the shaft 60, the accelerometer 20 is orientated such that the measurement axis of the accelerometer is parallel to the axis of the shaft and the direction of the acceleration to be measured is towards the club head.

The output from the accelerometer 20 is preconditioned by analogue circuitry, and the resultant signal is input to the processor 30 in which the signal is converted into the digital domain, and is processed to analyze the swing. Data on the swing is output to the display 40. Preconditioning depends on the technology used in the accelerometer. Some will require temperature compensation, most will need amplification. Low pass filtering may also be desirable to control EMC susceptibility. The important thing is that the signal has sufficient magnitude and stability to properly drive the ADC, and thus achieve suitable measurement accuracy and resolution.

The user controls 50 are preferably push-button switches. One would switch the unit on and off, and reset the display after each stroke. The other would allow the user to scroll through the various results. A combination of presses would allow setting up of the device 10 and any other settings which may be desired.

The user sets up the device by inputting a parameter corresponding to the length of their arm plus the length of the club. Following a swing, the device displays the peak speed, speed at impact and slowing distance on the display 40. Using this information, the golfer is able to make adjustments to the swing to improve his or her technique by seeking to increase club head speed at impact and reduce slowing distance.

The accelerometer is oriented to measure centripetal acceleration along the length of the shaft. It produces an electrical output which is processed by a processor 30. During a typical golf swing this output has the form shown in FIG. 5.

Two events occur during the stroke that are relevant: the swing itself, and the impact between the club head and the ball. During the swing the output changes smoothly and is characterised by a low frequency waveform. At the point of impact, very high tangential forces are produced, and these result in a disturbance in the sensor output which manifests as a high frequency burst. The difference in frequency content at the sensor output is used to distinguish between these two events.

The processor 30 monitors the accelerometer output at regular intervals. The swing is deemed to have started when the output of the accelerometer reaches a preset threshold. The monitoring of the processor 30 ensures that spurious outputs due to vibration, etc. do not cause invalid results. Once the swing has been determined to have begun, measurements are taken more frequently, as necessary to achieve the displayed distance resolution (at 100 mph, the club head typically travels 45 mm (almost 2 inches) every millisecond). Peak speed is deemed to have been reached when the succeeding measurement has a smaller magnitude than its predecessor.

Figure 5:
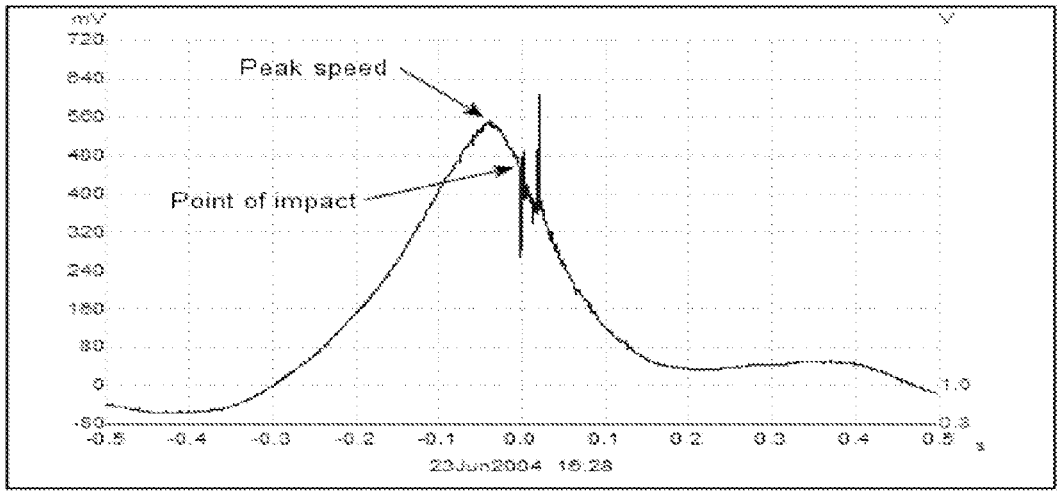
FIG. 5 is a graph illustrating detection of analysis events.

Impact with the ball is detected by monitoring the rate of change of acceleration. When impact occurs, rate of change will rise (increase in magnitude). The actual change in the waveform may be a rise or a fall—the distinguishing feature is the frequency content. Characteristically, there will be an HF burst accompanied by a sudden fall in centripetal acceleration, as shown in FIG. 5

Data is collected and stored in a memory until the impact is detected, at which time the most recent reading, corresponding to the acceleration just prior to impact is used to calculate club head velocity.

The processor 30 uses this data, together with the user-supplied parameter, to calculate the results, which are then presented to the user via the display device (e.g. a liquid crystal display) 40. Various results or combinations of results can be displayed, including peak speed, speed at impact and slowing distance.

The processor 30 calculates the results as follows:

$$\text{Peak Speed } v_{pk}=\sqrt{(a_{pk}*r)}$$

$$\text{Impact Speed } v_i=\sqrt{(a_i*r)}$$

$$\text{Slowing Distance } d=((v_{pk}+v_i)*(t_i-t_{pk}))/2$$

Where:

$v_{pk}$=peak tangential velocity
$v_i$=tangential velocity at impact
$a_{pk}$=peak centripetal acceleration
$a_i$=centripetal acceleration at time of impact
r=distance to centre of rotation
$t_i$=time of impact
$t_{pk}$=time of peak centripetal acceleration
d=slowing distance Note that during the very short time when the ball is in contact with the club head (~1 or 2 ms), tangential velocity approximates closely to linear speed.

Figure 6:
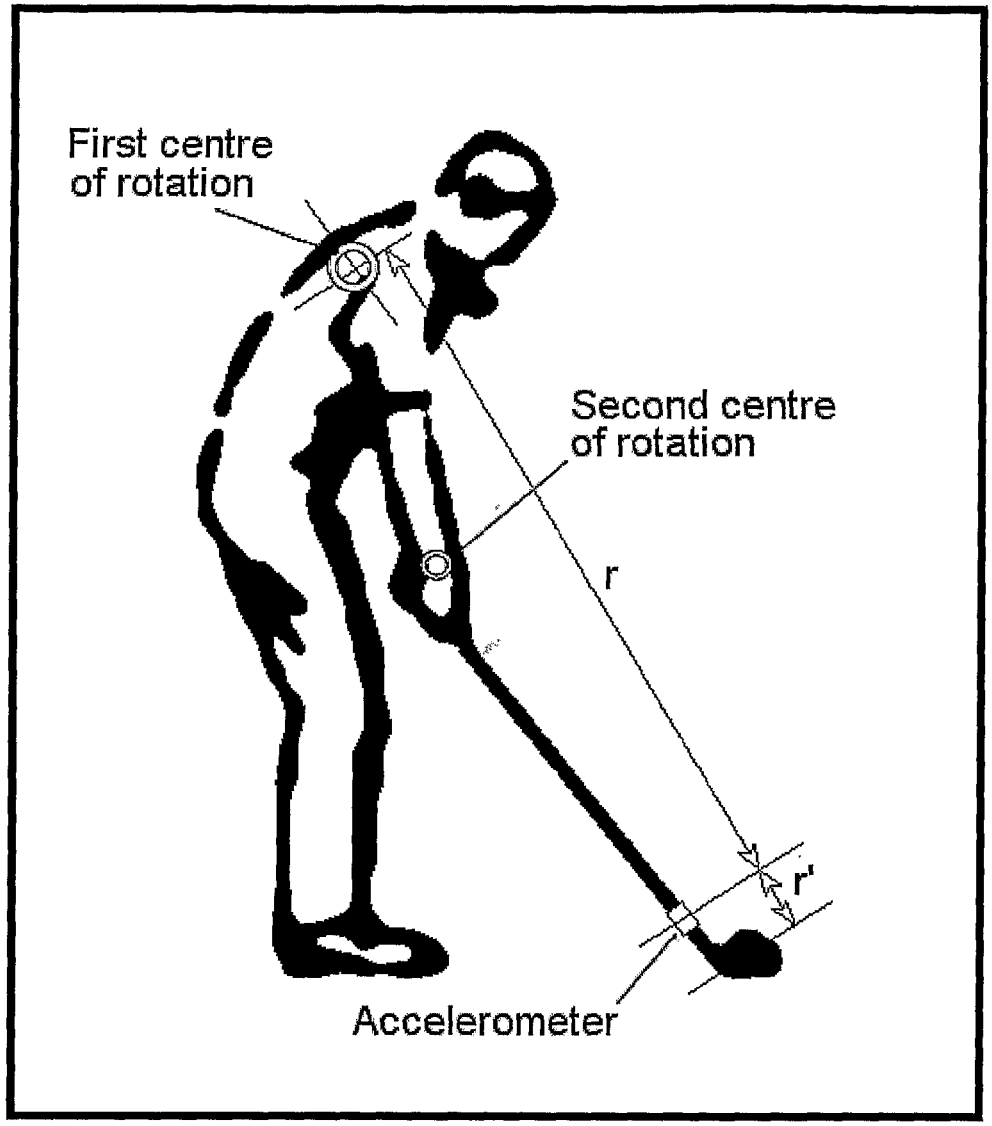
FIG. 6 is a diagram illustrating factors used in calculating a radius factor.

When a golf club is swung, the club head follows a curved path about two connected centres of rotation, as is illustrated in FIG. 6. A first centre of rotation is located generally between the golfer's shoulders. A second centre of rotation is formed by the golfer's wrists. At the time when the club head strikes the golf ball, the club head is generally aligned with the centres of rotation, and the direction of motion of the golfer's hands is generally parallel to the direction of motion of the club head.

The radius factor r in the above equations is the distance between a notional centre of rotation and the accelerometer. The distance between the accelerometer and the notional centre of rotation will depend on factors including the length of the user's arm and length of the club shaft. The radius factor r is derived from the combined length of the arm and club.

The user measures their arm length and the length of their club, adds these together, and enters this number into the device 10 on setup. This would only need to be done once for each person/club combination and the device 10 may include a memory for maintaining a number of user/club profiles. A small correction factor is applied by the device to arrive at the true radius, and to correct for the displacement between the device and the centre of mass of the club head.

The correction factor is necessary to account for the fact that the point of measurement is a small distance (typically less than 100 mm) from the centre of mass of the cub head. The true velocity at the head is thus:

$$v=\sqrt{(a_m{}^*r)^*(r+r')/r}$$

Where:

v=true tangential velocity of club head $a_m$=centripetal acceleration at measuring point r=distance from measuring point to centre of rotation r'=distance from measuring point to centre of mass of club head Other results could be calculated from the data gathered, e.g. swing count per hour/per session/per week, etc., average club head speed, average peak speed, average slowing distance, minimum slowing distance, maximum values, best strokes, swing tempo.

Another way of calculating the radius factor r could be to use the player's height, which field trials have indicated show a good correlation to the radius.

The device 10 could include a memory and be pre-programmed to indicate to the user after each swing whether that swing was better or worse than some other swing, for example a stored 'best' value, or perhaps the previous swing.

The radius factor r could be entered as two separate numbers, arm length and club length. This would have the advantage of being able to enter just club length on change of clubs for the same person. A number of different arm lengths and club lengths could be stored and recalled as required.

Data could be stored in the device, or on removable media, and later transferred to a personal digital assistant (PDA), Personal Computer (PC), or some other device for further analysis.

Figure 7:
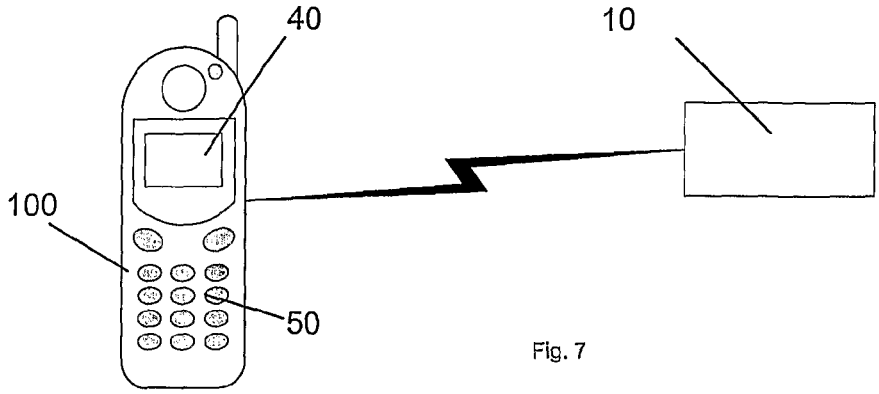
FIG. 7 is a schematic diagram of an embodiment according to an aspect of the present invention in which selected functionality is provided by a remote device; and, FIG. 8 is a schematic diagram of an alternate device according to an embodiment of the present invention.

Results could be transmitted wirelessly to another device, e.g. a PDA or a PC, using Bluetooth or the like. Indeed, results could be uploaded to a user's mobile telephone for storage and analysis. The device 10 need not necessarily include a display 40 or use controls 50 as these could be integrated with a remote device such as a mobile phone 100, as is shown in FIG. 7. A user configures a profile in the remote device 100 in advance by providing the data needed to calculate the radius factor r, this in turn is processed and uploaded wirelessly to the device 10 on the club which, after the stroke has been taken provides results back to the remote device 100.

The display could also take the form of a 'wristwatch' coupled to the measuring unit via a wireless data link.

Embodiments of the present invention are also applicable to swing analysis for clubs other than drivers, to aid the golfer in achieving consistency in the weight of a stroke, and therefore improve the player's game.

Additionally, embodiments of the present invention are also applicable for use in swing analysis in other sports involving swinging an implement (like a bat or club) and hitting a ball, e.g. tennis, baseball, etc.

Figure 8:
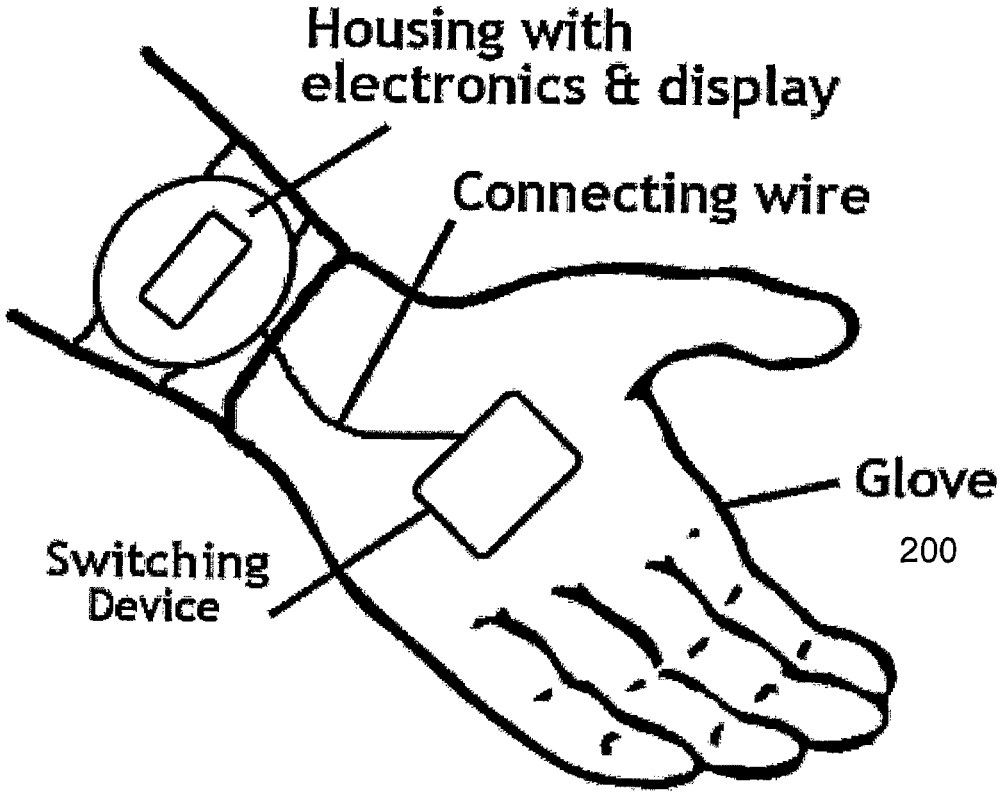

Embodiments of the present invention would also be applicable in sports where a rotational movement, but no impact, is involved (e.g. discus, hammer-throwing). In such cases, the device could then be attached to the athlete's wrist, and it would be necessary to detect the point of release instead of point of impact. This could be done by using a pressure sensor or other switching device held in the hand or housed in a glove 200, as is shown in FIG. 8. The sensor would provide a signal when the projectile was released, and this would be used to trigger the device.

The invention claimed is:

1. A swing performance analysis device comprising a sole single axis accelerometer securable on a shaft of a golf club substantially adjacent to the golf club's head to measure centripetal acceleration, the accelerometer being arranged to communicate with a processor, wherein the processor is arranged to accept one or more parameters on the swing to be analysed and measurement data on the swing from the accelerometer, the processor being operative to determine the radius of curvature of the swing calculate in dependence on the one or more parameters and to determine one or more attributes on the swing in dependence on the radius and measurement data, the one or more attributes including a slowing distance (d):

$$d=((v_{pk}+v_i)^*(t_i-t_{pk}))/2$$

Where:

$v_{pk}$=peak tangential velocity=$\sqrt{(a_{pk}{}^*r)}$ $v_i$=tangential velocity at impact=$\sqrt{(a_i{}^*r)}$ $a_i$=centripetal acceleration at time of impact $a_{pk}$=peak centripetal acceleration $t_i$=time of impact $t_{pk}$=time of peak centripetal acceleration r=distance to centre of rotation.

2. A swing performance analysis device according to claim 1, wherein the device comprises a housing securable to the shaft of the golf club, the accelerometer being mounted in the housing such that upon securement of the device to the shaft of the golf club, the axis of measurement of the accelerometer is parallel to the longitudinal axis of the shaft.

3. A swing performance analysis device according to claim 1, wherein the one or more parameters include the length of the user's arm.

4. A swing performance analysis device according to claim 3, wherein the processor is arranged to monitor measurement data from the accelerometer to determine when a swing is being taken and a point of impact, wherein measurement data corresponding to a swing being taken comprises a low frequency waveform and measurement data corresponding to a point of impact comprises a high frequency burst or sudden reduction in centripetal acceleration.

5. A swing performance analysis device according to claim 4, wherein a swing is deemed to have started when the output of the accelerometer reaches a predetermined threshold.

6. A swing performance analysis device according to claim 5, wherein the processor being arranged to sample measurement data more frequently once a swing is deemed to have started.

7. A swing performance analysis device according to claim 4, wherein upon detection of a point of impact, the processor is arranged to calculate club head velocity by the formula:

$$v_i=\sqrt{(a_i{}^*r)}.$$

8. A swing performance analysis device according to claim 1, wherein the processor is arranged to determine a peak speed of the swing, the peak speed comprising measurement data received from the accelerometer having a smaller magnitude than its predecessor.

9. A swing performance analysis device according to claim 1, wherein the processor is remote from the accelerometer.

10. A swing performance analysis device according to claim 9, wherein the processor and accelerometer communicate wirelessly.

* * * * *